US007140524B2

(12) United States Patent
Hung et al.

(10) Patent No.: US 7,140,524 B2
(45) Date of Patent: Nov. 28, 2006

(54) NAILING MACHINE WITH A SAFETY MECHANISM

(75) Inventors: Sunking Hung, Taichung (TW); Leo Huang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/056,624

(22) Filed: Feb. 14, 2005

(65) Prior Publication Data

US 2006/0180628 A1 Aug. 17, 2006

(51) Int. Cl.
*B27F 7/17* (2006.01)

(52) U.S. Cl. ..... 227/8; 227/10; 227/130; 227/142

(58) Field of Classification Search ..... 227/8, 227/142, 120, 130
See application file for complete search history.

(56) References Cited

U.S. PATENT DOCUMENTS 5,366,132 A * 11/1994 Simonelli ..... 227/8
5,785,227 A * 7/1998 Akiba ..... 227/8
6,199,739 B1 * 3/2001 Mukoyama et al. ..... 227/8
6,264,085 B1 * 7/2001 Ho et al. ..... 227/8
6,592,014 B1 * 7/2003 Smolinski ..... 227/8
6,783,044 B1 * 8/2004 Perra et al. ..... 227/8
6,966,476 B1 * 11/2005 Jalbert et al. ..... 227/8
6,966,477 B1 * 11/2005 Chien-Kuo et al. ..... 227/8

* cited by examiner

*Primary Examiner*—John Sipos
*Assistant Examiner*—Michelle Lopez
(74) *Attorney, Agent, or Firm*—Egbert Law Offices

(57) ABSTRACT

The nailing machine with safety mechanism is located between fastener and nailing part of nailing machine. The safety mechanism includes an adjustable shelf, which shifts recurrently within a limited range. The first end of adjustable shelf is linked to the fastener, and second end extends towards nailing part. One side of retainer is normally protruded from exterior of nailing part, and the other side extends towards adjustable shelf. The revolving controller is provided with a pin joint and a revolving end. The revolving end will limit and fix simultaneously adjustable shelf and retainer, or, in the case of second swinging angle, the revolving end will release adjustable shelf and retainer. When an idle nailing machine is firstly withheld by a fastener, the adjustable shelf will shift outwards, and then drive revolving end of revolving controller to separate from the adjustable shelf.

4 Claims, 10 Drawing Sheets

NAILING MACHINE WITH A SAFETY MECHANISM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a nailing machine, and more particularly to an innovative nailing machine designed with safety mechanism against accidental discharge.

BACKGROUND OF THE INVENTION

The nailing machine, known as a nailing tool, is used to hammer the nails into workpieces. In order to avoid accidental discharge of nailing machine prior to contact of workpieces, most of existing nailing machines are equipped with a safety mechanism, which is available with many models of limited common grounds. In brief, the safety mechanism generally refers to a movable component mounted between a trigger and ejaculator of a nailing machine. The inner side of a movable component is limited at a trigger arm between the trigger and starting switch, while the exterior of movable component overpasses the ejaculator. The operating principle is that, if the trigger is pressed accidentally prior to nailing machine's contact with workpieces, the driving force will be discharged via trigger arm and movable component, making it impossible to brake the starting switch for nailing action, since the exterior of movable component in a suspended state isn't blocked. To the contrary, the exterior of the movable component is to be blocked and fixed when nailing machine contacts the workpieces. So, when the operator presses the trigger, the trigger arm will be activated simultaneously to press smoothly the starting switch for nailing action. However, the typical nailing machine's safety mechanism will yield the following problems during practical applications.

If the trigger is activated accidentally in the case of idle state of ejaculator (i.e. without contact with workpieces), and the exterior of safety mechanism outside of ejaculator touches any object, a slight recession will probably trigger the starting switch to activate a nailing work. Even if the exterior of ejaculator touches accidentally any object (e.g. electric wire and human body, etc.) when the user moves nailing machine, an unintentional nailing work will likely occur. It can thus be seen that, a nailing machine is a handheld device of strong lethality, and poses some potential risks in the worksite in some special circumstances. Therefore, particular attention shall be paid to the safety factors in the course of mechanical design. The aforementioned show that the safety mechanism of typical nailing machine cannot yet satisfy the overall requirement.

Thus, to overcome the aforementioned problems of the prior art nailing machine with a safety mechanism, it would be advancement in the art to provide an improved one of higher safety.

To this end, the inventors have provided the present invention of practicability after deliberate design and evaluation based on years of experience in the production, development and design of related products.

BRIEF SUMMARY OF THE INVENTION

The object of the present invention is to provide an innovative design that safety mechanism comprises an adjustable shelf, a retainer and a revolving controller. When an idle nailing machine is withheld by a fastener, the adjustable shelf will shift outwards, and then drive revolving controller to separate from the adjustable shelf. So, the revolving controller and retainer are separately staggered. Even if the retainer recedes due to contact of workpiece, adjustable shelf will not be stopped and fixed, namely, withholding of fastener is invalid and will not yield a safety concern for nailing action. Based on this innovative design that covers more safety considerations than in conventional safety mechanism, it is possible to achieve a higher degree of safety against accidental discharge of nailing machine.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
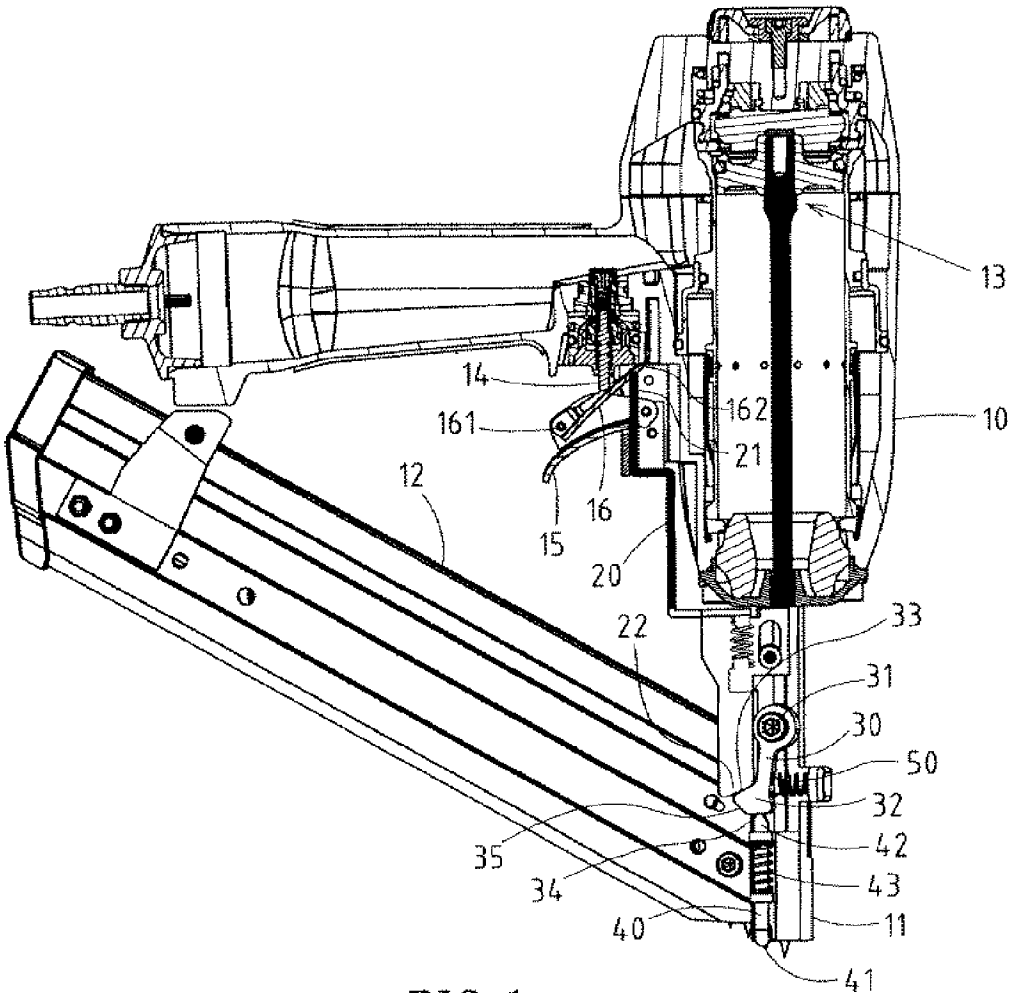
FIG. 1 shows a schematic view of operating the present invention.

The features and the advantages of the present invention will be more readily understood upon a thoughtful deliberation of the following detailed description of a preferred embodiment of the present invention with reference to the accompanying drawings.

As shown in FIGS. 1–4, there is a nailing machine with safety mechanism embodied in the present invention.

The invention includes a mainframe 10, a nailing part 11, a cartridge 12, a drive part 13, a trigger switch 14, a fastener 15, a trigger 16 and a safety mechanism. The trigger 16 is located between the fastener 15 and trigger switch 14, where it is mounted onto inner side of a movable end of fastener 15 via a support 161 (a stud shaft in this embodiment). And, the inner side of movable end 162 of trigger 16 is linked to the trigger switch 14.

The safety mechanism, located between the trigger 16 and nailing part 11, comprises an adjustable shelf 20, which shifts recurrently along a straight track. The inner side 21 of adjustable shelf 20 is linked to the exterior of movable end 162 of the trigger 16, while the adjustable shelf 20 can restore flexibly towards nailing part 11 via a flexible restorer 201. The safety mechanism comprises a revolving controller 30 and a retainer 40, of which the roof-bolting retainer 40 is mounted into nailing part 11. With the aid of an elastic member 43 (a spiral spring in this embodiment), the exterior 41 of retainer 40 is normally protruded from the outer side of nailing part 11, while the inner side 42 of retainer 40 and outer side of adjustable shelf 20 are separately staggered. The revolving controller 30 is provided with a pin joint 31 properly placed at one side of exterior of adjustable shelf 20, while the revolving end 32 extends between the exterior of adjustable shelf 20 and the inner side 42 of retainer. The revolving end 32 can be fitted with a pusher 33 opposite to the adjustable shelf 20, and also with a retaining surface 34 and a receding surface 35 opposite to the inner side 42 of retainer 40. Besides, a flexible shoring member 50 is mounted at one side of revolving end 32 of revolving controller far away from adjustable shelf 20, thereby pushing normally the revolving end 32 towards adjustable shelf 20.

Of which, the pusher 33 of revolving controller 30 ad exterior 22 of adjustable shelf 20 can be combined with an oblique plane or curved plane.

The retaining surface 34 and receding surface 35 at revolving end 32 of revolving controller 30 can be designed with two surfaces of different angles.

Figure 2:
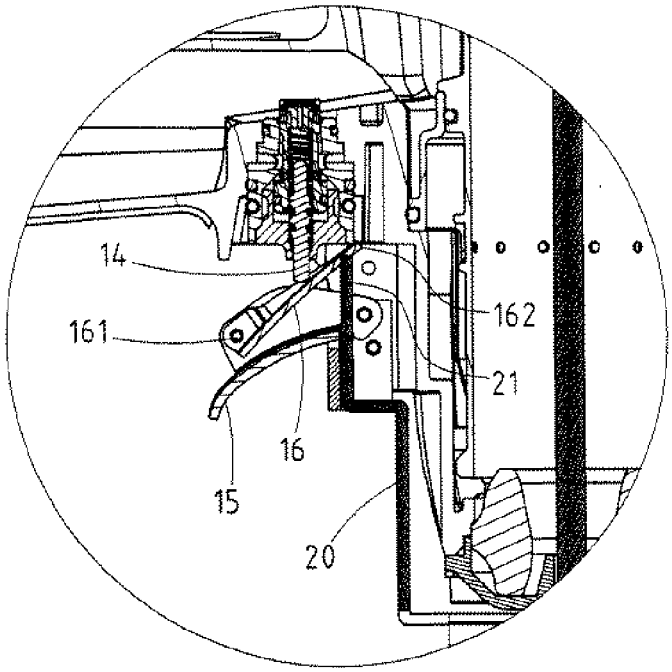
FIGS. 2–3 show the local magnified sectional views of the present invention.
Figure 3:
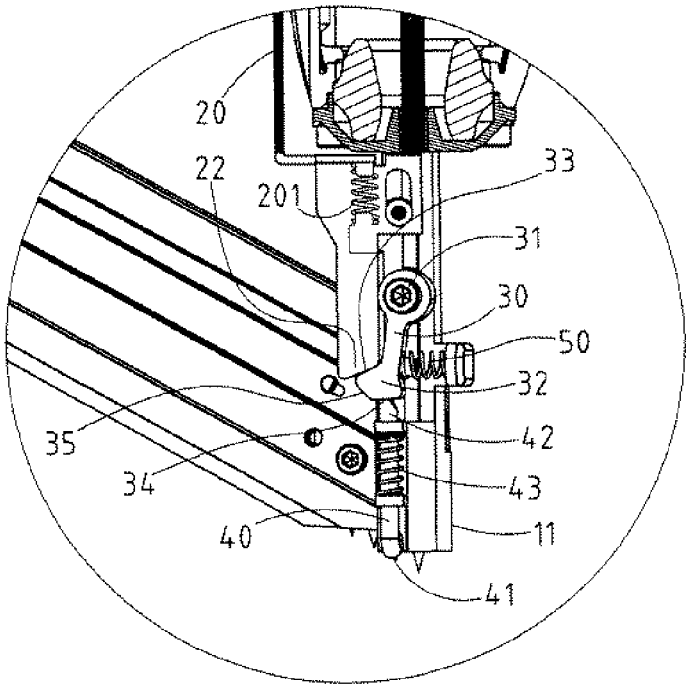
Figure 4:
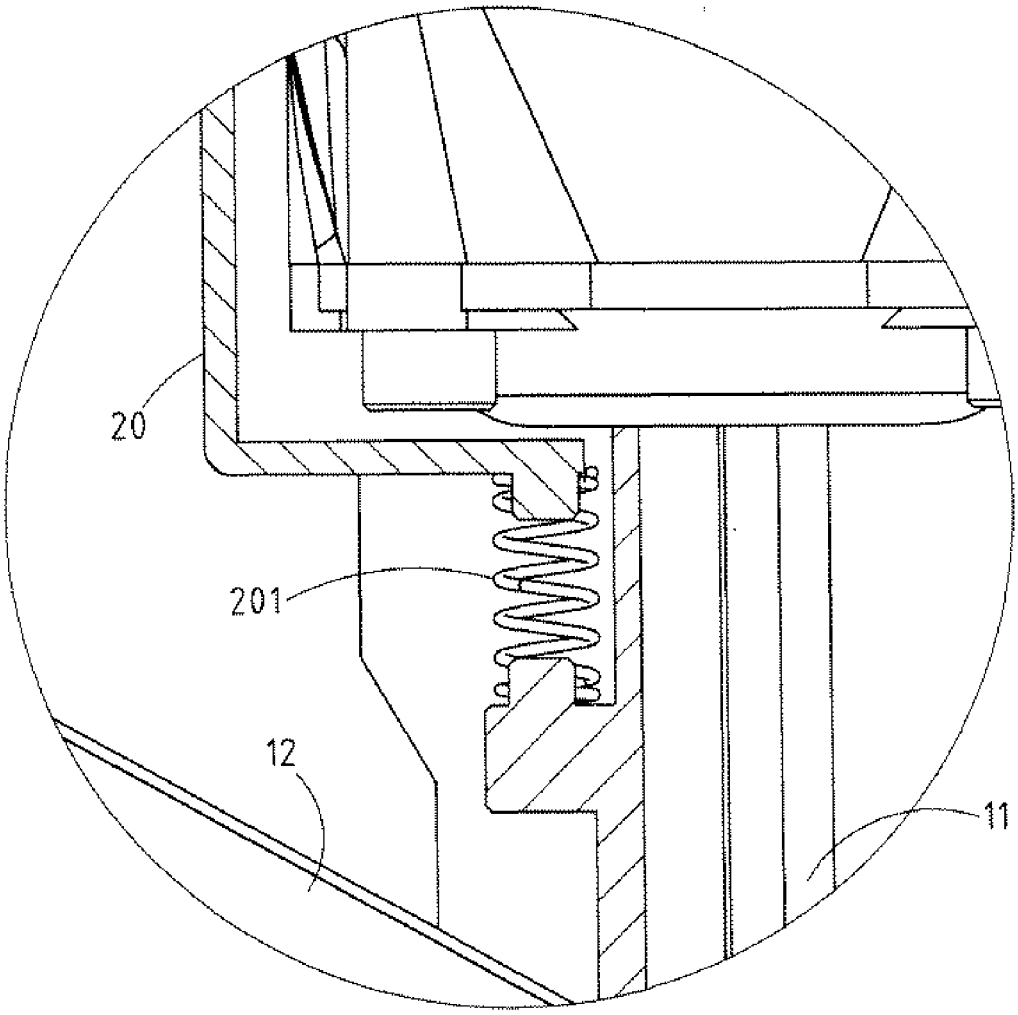
FIG. 4 shows a schematic view of the adjustable shelf affixed with flexible restorer.
Figure 5:
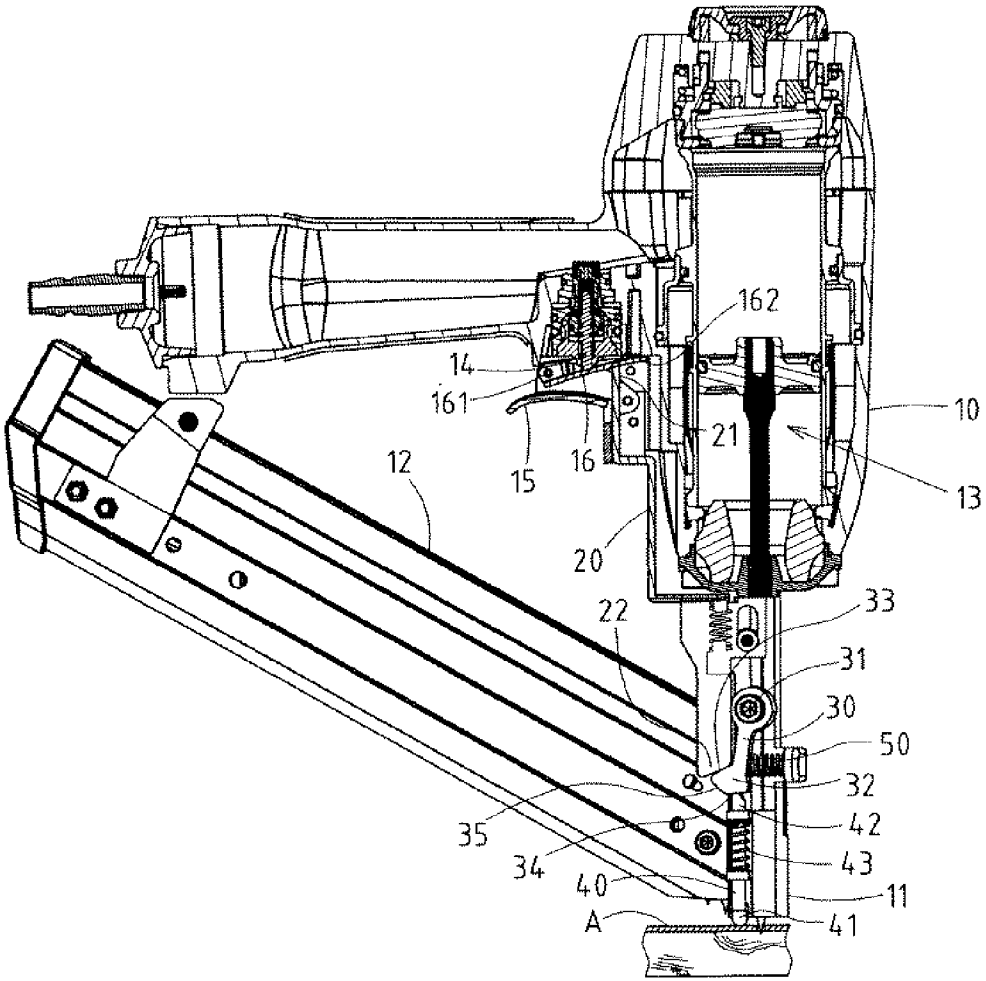
FIG. 5 shows a schematic view of another operating of the present invention.
Figure 6:
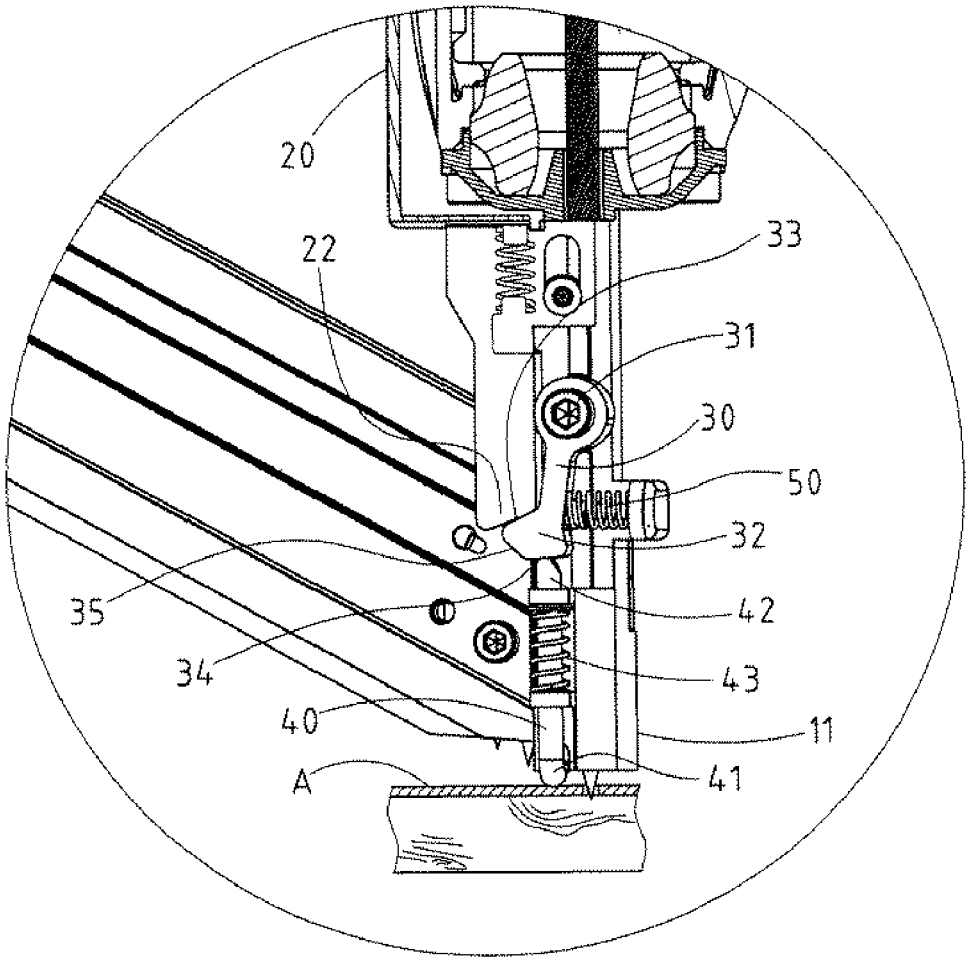
FIG. 6 shows a local magnified perspective view of FIG. 5.

Based upon above-specified structural design, the detail of operation is described below:

As shown in FIGS. 1–3, since the revolving end 32 of revolving controller 30 is pushed by a flexible shoring member 50 in a normal state, the swinging position enables the retaining surface 34 of revolving end to be stopped at inner side 42 of retainer 40. As shown in FIGS. 5–6, when the exterior 41 of retainer 40 contacts the workpiece A, the movable end 162 of trigger 16 is fixed by the inner side 21 of adjustable shelf 20, since the exterior 22 of adjustable shelf 20 is also retained by the pusher 33 of revolving controller 30. In case where the fastener is withheld, the inner side of trigger 16 will shift inwards and stops at trigger switch 14 to activate the nailing action.

Figure 7:
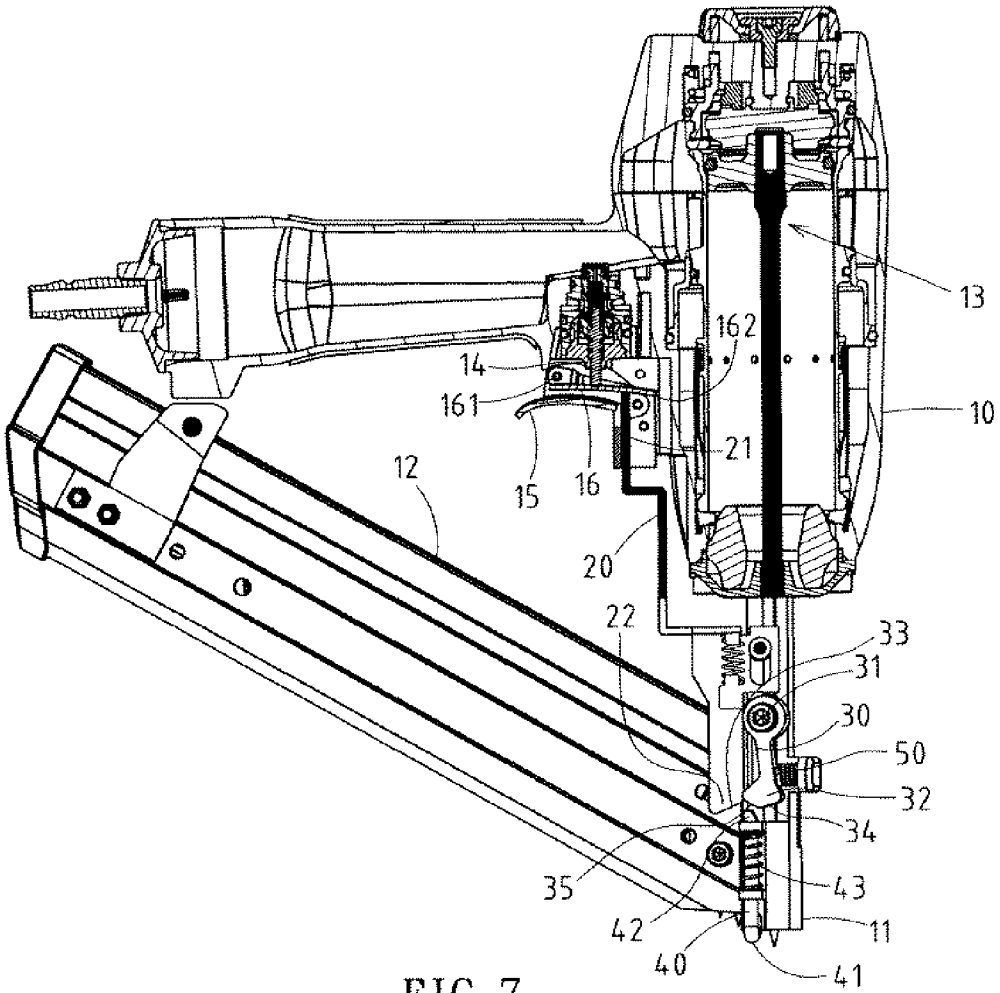
FIG. 7 shows another perspective operating view of the present invention.
Figure 8:
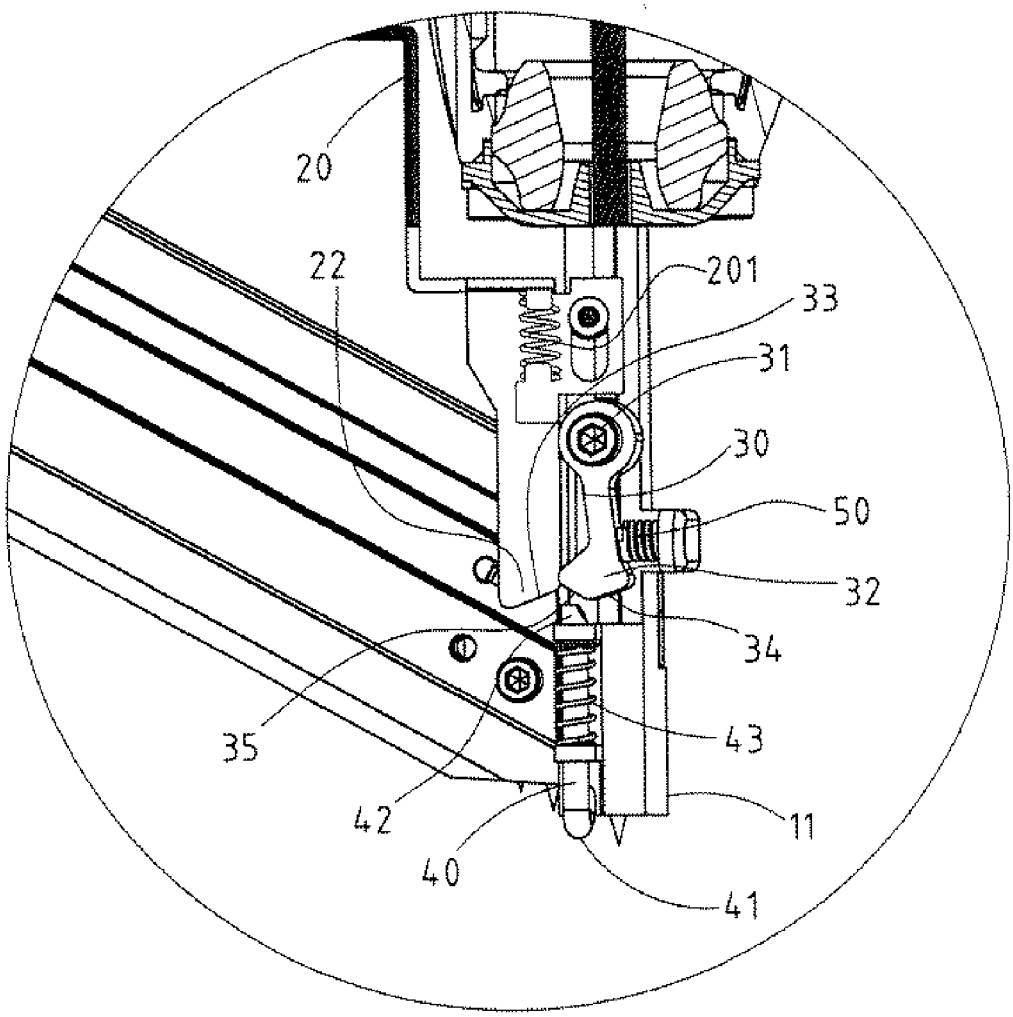
FIG. 8 shows a local magnified perspective view of FIG. 7.
Figure 9:
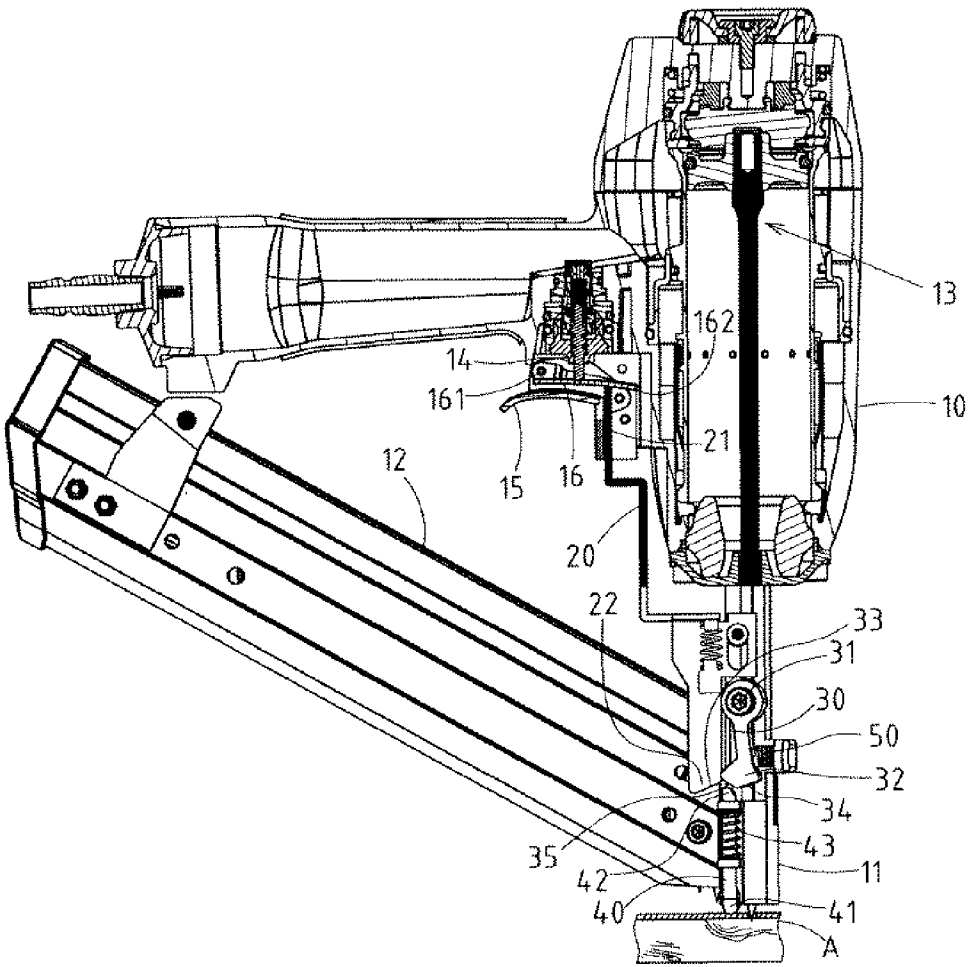
FIG. 9 shows another operating perspective view of the present invention.
Figure 10:
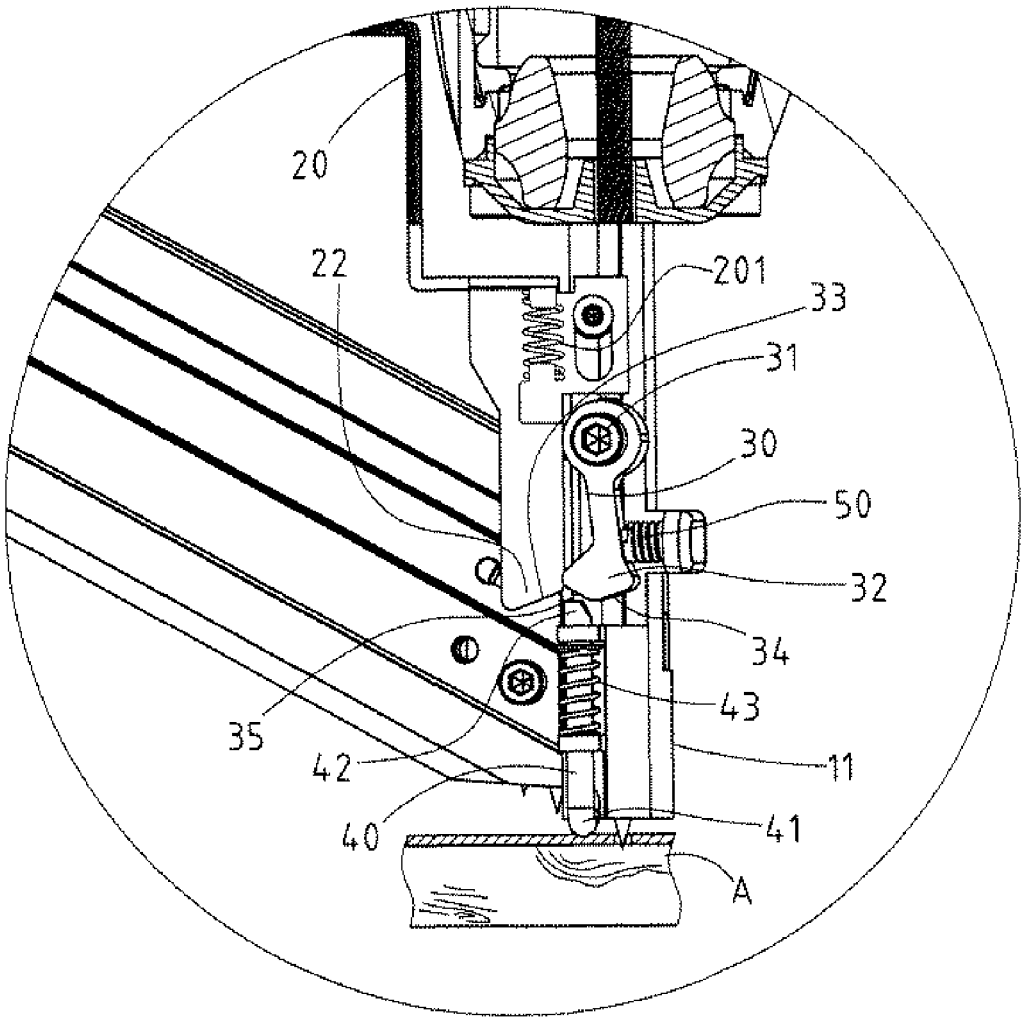
FIG. 10 shows a local magnified perspective view of FIG. 9.

As shown in FIGS. 7–8, in case where the exterior 41 of retainer 40 is in an idle state (without contact of workpieces), and the fastener 15 is firstly withheld, the adjustable shelf 20 will be driven by movable end 162 of trigger 16 to shift outwards, and then activate the revolving end 32 of revolving controller 30 to swing rightwards (as demonstrated in the figure) and separate from the exterior 22 of adjustable shelf 20. Meanwhile, the receding surface 35 is placed oppositely to inner side of retainer 40. As shown in FIGS. 9–10, when the retainer 40 recedes due to contact of workpiece A or other foreign materials, its inner side 42 will be trapped into receding surface 35, and adjustable shelf 20 will not be fixed, namely, withholding of fastener 15 is invalid and will not yield a safety concern for nailing action, thereby achieving a higher degree of safety against accidental discharge.

Figure 11:
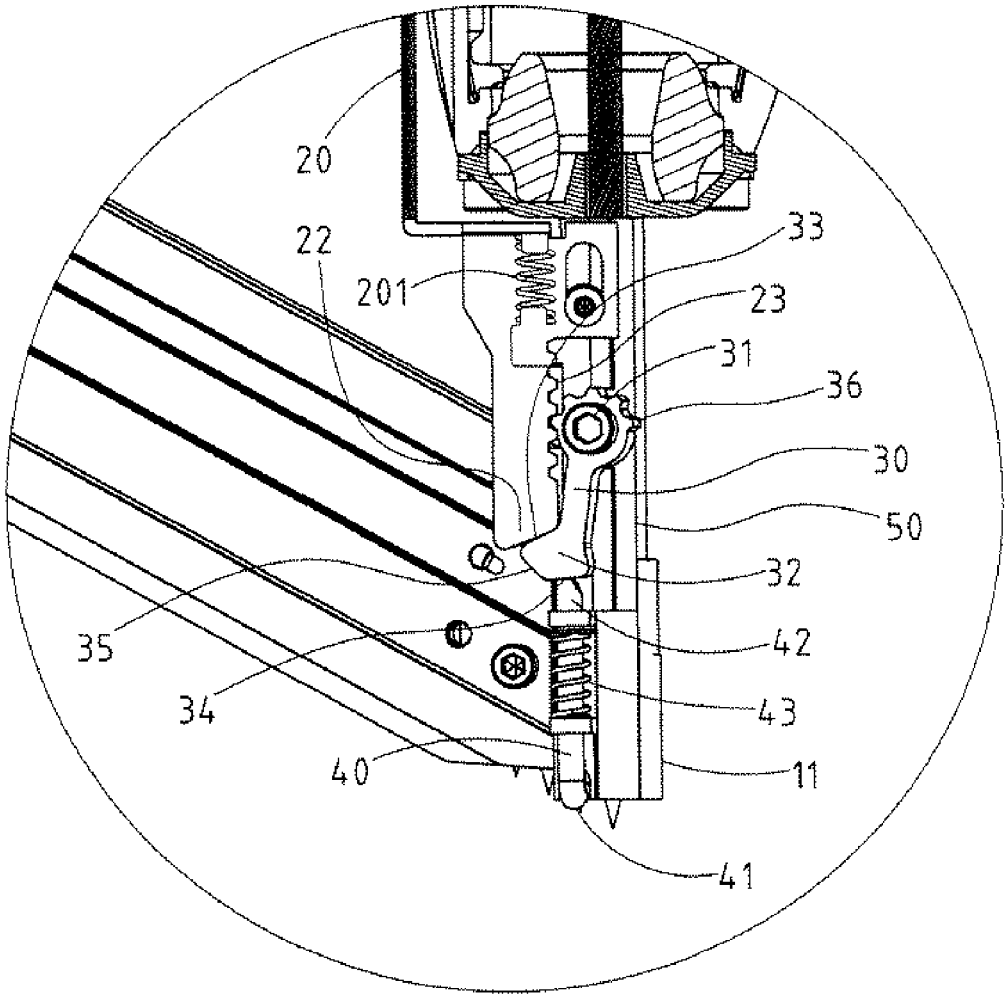
FIG. 11 shows a schematic view of the structure of the present invention.

FIG. 11 shows another preferred embodiment of the present invention, which differs from aforementioned ones as detailed below: a friction drive is placed at pin joint 32 of revolving controller 30 opposite to exterior of adjustable shelf 20, such that the shift of adjustable shelf 20 will drive the revolving end 32 of revolving controller 30. Of which, the friction drive can be designed with a structure incorporating gear face 36 and tooth rake 23 for an engaged drive. Certainly, it can also be designed with an actuating mechanism via other frictional forces, such as design of rough surface. Such an embodiment can eliminate the need to use flexible shoring member 50 in preceding embodiment.

We claim:

1. A nailing apparatus comprising:

a main frame;

a nailing means connected to said main frame for urging a nail outwardly of said main frame, said nailing means having a dispensing end;

a cartridge interconnected to said main frame suitable for receiving nails therein;

a driving means positioned in said main frame for driving said nailing means so as to drive the nail outwardly;

a trigger means cooperative with said driving means for actuating said driving means, said trigger means having a trigger extending outwardly of said main frame;

a fastener extending outwardly of said main frame and connected to said trigger of said trigger means, said fastener suitable for actuating said trigger means;

an adjustable shelf extending along an exterior of said main frame, said adjustable shelf having a first end linked to said fastener, said adjustable shelf having a second end extending toward said nailing means;

a retainer element slidably positioned adjacent to said nailing means, said retainer element having a first end extending outwardly adjacent said dispensing end of said nailing means, said retainer element having a second end facing said second end of said adjustable shelf;

a revolving controller pivotally mounted by a pin joint to said main frame, said revolving controller having an end opposite said pin joint, said end of said revolving controller movable between a first position interposed between said second end of said adjustable shelf and said second end of said retainer element and a second position free of said second end of said adjustable shelf and said second end of said retainer element, said adjustable shelf resiliently urged upwardly toward said fastener;

a flexible shoring member connected to said main frame and urging against said revolving controller so as to urge said revolving controller toward said first position, said revolving controller having an arm extending from said pin joint to said end, opposite said pin joint, said end of said revolving controller having a pusher surface extending at an obtuse angle relative to said arm, said second end of said adjustable shelf having a surface in surface-to-surface sliding contact with said pusher surface of said revolving controller when said revolving controller is in said first position, said end of said revolving controller having a retaining surface extending generally transverse to a longitudinal axis of said retainer element when said revolving controller is in said first position, said end of said revolving controller having a receding surface extending inwardly from said pusher surface and said retaining surface on a side opposite said arm, said retainer element being resiliently mounted so as to urge said second end thereof against said end of said revolving controller, said trigger mounted to a movable end of said fastener by a support first, said end of said adjustable shelf being linked to said movable end of said fastener.

2. The nailing apparatus of claim 1, further comprising:

an actuating mechanism positioned between said adjustable shelf and said joint pin for a frictional engagement between said adjustable shelf and said revolving controller such that movement of said adjustable shelf drives said end of said revolving controller from said first position toward said second position.

3. A safety mechanism for use between a trigger and a nailing part of a nailing machine, the safety mechanism comprising:

an adjustable shelf extending between the trigger and the nailing part, said adjustable shelf having a first end interconnected to the trigger and a second opposite end extending to the nailing part;

a retainer element slidably positioned relative to said adjustable shelf, said retainer element having an end facing said second end of said adjustable shelf;

a revolving controller pivotally mounted by a pin joint to a main frame of the nailing machine, said revolving controller having an end opposite said pin joint, said end of said revolving controller movable between a first position interposed between said second end of said adjustable shelf and said second end of said retainer element and a second position free of said second end of said adjustable shelf and said second end of said retainer element, said adjustable shelf resiliently urged upwardly toward said trigger toward said first position, said revolving controller having an arm extending from said pin joint to said end, said end of said revolving controller having a pusher surface extending at an obtuse angle relative to said arm, said second end of said adjustable shelf having a surface in surface-to-surface sliding contact with said pusher surface of said revolving controller when said revolving controller is in said first position, said end of said revolving controller having a retaining surface extending generally transverse to a longitudinal axis of said retainer element when said revolving controller is in said first position, said end of said revolving controller having a receding surface extending inwardly from said pusher surface and said retaining surface on a side opposite said arm.

4. The safety mechanism of claim 3, further comprising:

a flexible shoring member contacting said revolving controller so as to urge said revolving controller toward said first position.

* * * * *